US005671782A

United States Patent [19]

Lemaire et al.

[11] Patent Number: 5,671,782

[45] Date of Patent: Sep. 30, 1997

[54] HARNESS TO LIFTING CORD THREE PART CONNECTOR FOR A JACQUARD WEAVING MACHINE

[75] Inventors: Thierry Lemaire, Marcq-en-Baroeul, France; Carlos Derudder, Heule/Kortrijk, Belgium

[73] Assignee: N.V. Michel Van de Wiele, Marke/Kortrijk, Belgium

[21] Appl. No.: 502,892

[22] Filed: Jul. 17, 1995

[30] Foreign Application Priority Data

Jul. 18, 1994 [BE] Belgium ..... 09400673

[51] Int. Cl.[6] ..... D03C 3/40

[52] U.S. Cl. ..... 139/85; 403/331; 403/341; 403/375; 24/656

[58] Field of Search ..... 403/331, 375, 403/341, 348, 381, 325, 329; 139/85, 86; 24/513.1, 656, 666

[56] References Cited

U.S. PATENT DOCUMENTS

| | | | |
|---|---|---|---|
| 637,256 | 11/1899 | Hepfner | 403/341 |
| 1,982,183 | 11/1934 | Tarbox | 403/331 |
| 3,422,502 | 1/1969 | McCarthy . | |
| 3,885,598 | 5/1975 | Vogelbacher | 139/85 |
| 4,034,782 | 7/1977 | Bucher . | |
| 4,733,442 | 3/1988 | Asai | 403/341 |
| 5,123,455 | 6/1992 | Marina | 139/452 |
| 5,143,477 | 9/1992 | Kanehira et al. | 403/341 |
| 5,309,950 | 5/1994 | Bassi et al. | 139/85 |
| 5,355,911 | 10/1994 | Kuster et al. | 139/85 |

FOREIGN PATENT DOCUMENTS

| | | |
|---|---|---|
| 1258285 | 3/1961 | France . |
| 2042014 | 2/1971 | France . |
| 4213958 | 4/1993 | Germany . |

*Primary Examiner*—Andy Falik

*Attorney, Agent, or Firm*—James Creighton Wray

[57] ABSTRACT

A coupling device allows for the rapid releasable connection of harness cords to lifting cords on weaving machines. A first coupler is connected to lifting cords and a second coupler is connected to harness cords. An intermediate coupler is removable connected to the first and second couplers. The intermediate coupler allows for quick and easy, manual or automatic, coupling and decoupling of the first and second elements. The second coupling elements and the intermediate elements are adapted so that only the connection therebetween is breakable when pulling forces are exerted thereon.

10 Claims, 3 Drawing Sheets

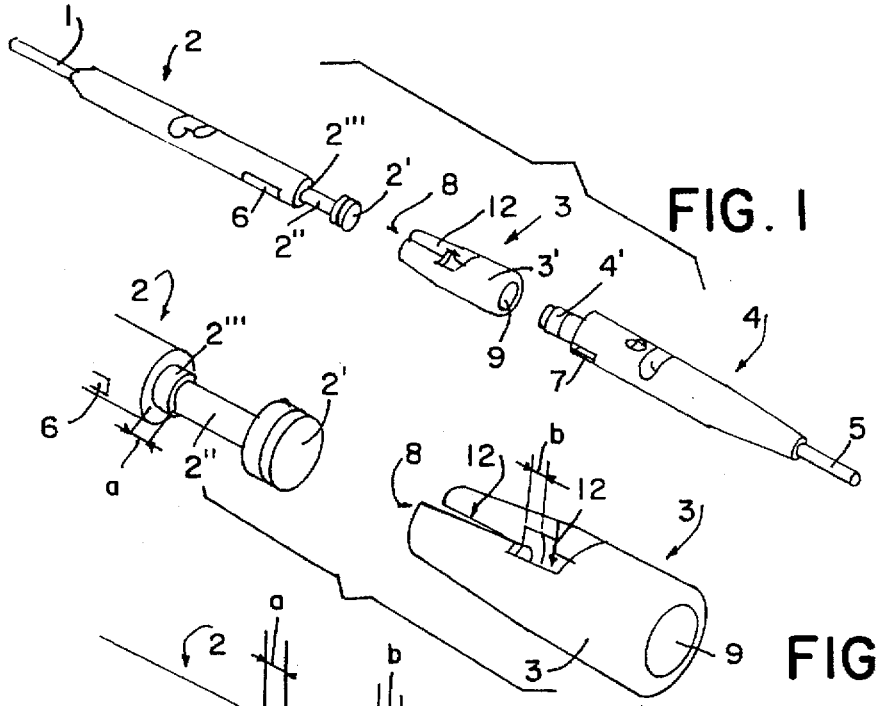
FIG. 1
FIG. 2
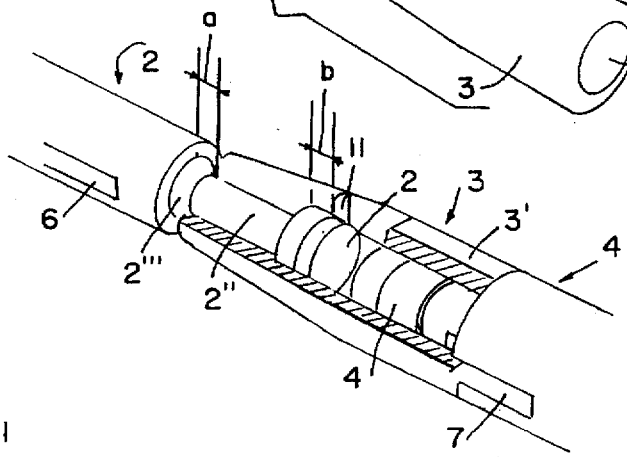
FIG. 3
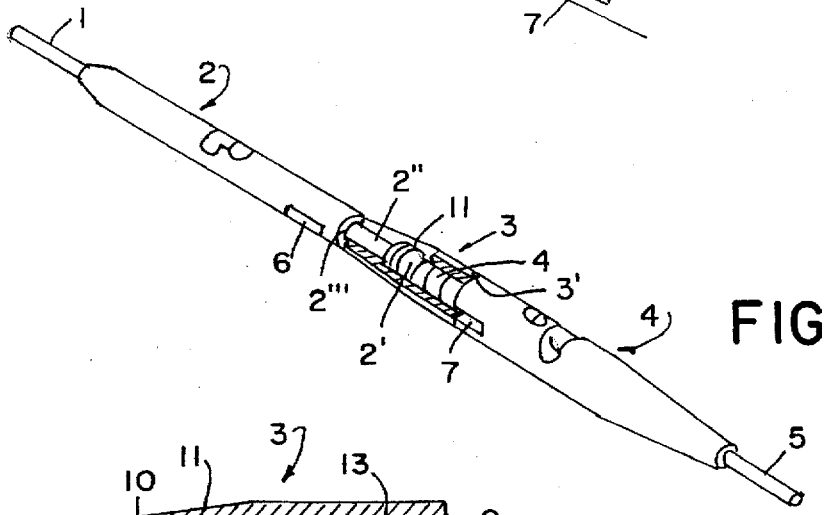
FIG. 4
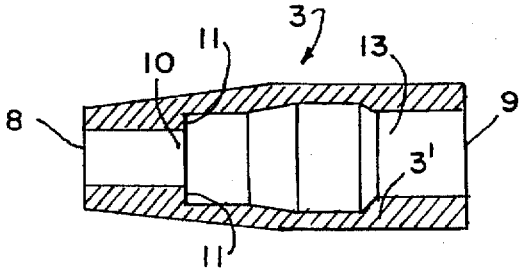
FIG. 5

HARNESS TO LIFTING CORD THREE PART CONNECTOR FOR A JACQUARD WEAVING MACHINE

BACKGROUND OF THE INVENTION

The present invention relates to a device for connecting, on the one hand, a lifting cord of a device for lifting one or more warp threads on a weaving machine and, on the other, at least one harness cord which is provided for lifting a warp thread, comprising a first and a second coupling element which are connected to the lifting cord and to the above-mentioned harness cord respectively, and which can be coupled and uncoupled.

A fabric consists essentially of warp threads and weft threads, and is formed on a weaving machine by each time forming a shed between the various warp threads, and inserting a weft thread through said shed. Before each insertion of the weft thread, certain warp threads are lifted to a well-defined height, at the point where the weft thread is to be inserted, by a device for lifting the warp threads, in order to form the desired shed. The positions of the various warp threads are determined relative to the successive weft threads depending on a fabric to be produced. The positioning of the warp threads is generally carried out by means of lifting cords, which are connected to harness cords by means of a detachable connecting device, while each harness cord is provided for lifting a warp thread (for example, by means of a heald which is connected to the harness cord and has a heald eye, through which the warp thread extends). Several harness cords can be connected to the same lifting cord if each of the warp threads connected to said harness cords has to assume the same position each time during the weaving.

Devices of the type described in the first paragraph of this description are known from European Patent Application No. 0,546,967 and from German Patent No. 4,213,958.

The device described in this European patent application comprises a first coupling element, which is connected to the lifting cord and consists of two flank pieces which are connected to each other by means of a crosspiece. A second coupling element, which is connected to several harness cords, is in the form of a clip, the two upward directed arms of which end in a hook shape. The hook-shaped parts face each other, and the arms are elastically deformable. By pushing the arms away from each other, the crosspiece can be placed in the space between the arms, below the hook-shaped parts. When the arms are sprung back to their original positions, they enclose the crosspiece, and the hook-shaped parts rest on the top surface of the crosspiece. The two coupling elements are connected to each other in this way, and they can no longer be uncoupled as the result of an axial pulling force. Indeed, for uncoupling the coupling elements, two flanks of the second coupling element, which are connected to the arms, have to be forced towards each other, in order to move the arms away from each other until the crosspiece can pass between the hook-shaped parts, in order to leave the space between the arms.

In the case of the device described in the abovementioned German patent the first coupling element comprises a sleeve, and the second coupling element comprises two upward directed, elastically deformable arms situated opposite each other. The arms are formed in such a way that they each form a supporting edge at the sides facing away from each other. For the coupling of the two coupling elements, the arms are inserted through an opening into the sleeve. The arms are forced towards each other by the inside walls of the sleeve. A widened part is also provided inside the sleeve, by means of which an inside edge is formed in the sleeve. The arms can spring back from each other in this widened part, with the result that their supporting edges ultimately rest above the inside edge of the sleeve. Due to the fact that the supporting edges of the arms knock against the inside edge of the sleeve, the second coupling element can no longer leave the sleeve as the result of an axial pulling force.

For the uncoupling thereof, the arms actually have to be forced towards each other in the radial direction, in order to be able to make them leave the sleeve through the opening.

In the case of the devices of the prior art described above, the coupling elements cannot become detached from each other under the influence an axial pulling force exerted thereon without damage occurring.

During weaving it can happen that, as the result of a knot becoming caught up or several warp threads becoming entangled, a warp thread becomes so taut that a normal lift of the warp thread becomes impossible.

However, the device for lifting the warp threads continues working, in order to lift the warp thread. This results in breakage of the warp thread, or a part of the device for lifting the warp thread, or a part lying in between which has been provided to transmit the lifting movement to the warp thread.

In the case of a jacquard machine, which interacts with tackle elements for achieving the lift, either the warp thread or the weakest part of the following parts will break: the jacquard machine hook, the tackle element, the tackle cord, the harness hook, the harness cord, or the jacquard heald. In particular, if relatively strong warp threads are being used in the weaving, parts will be damaged when a warp thread becomes caught up.

In the case of electronically controlled jacquard machines one of the following parts can break: the suspension element of the hook, the hook itself, the tackle element, the tackle cord, or the jacquard hook of the tackle cord.

In each case expensive parts have to be replaced. These replacements are also very time-consuming.

SUMMARY OF THE INVENTION

The object of this invention is to overcome this disadvantage. This object is achieved by providing a device for connecting, on the one hand, a lifting cord of a device for lifting one or more warp threads on a weaving machine and, on the other, at least one harness cord which is provided for lifting a warp thread; comprising a first and a second coupling element, which are connected to the lifting cord and to the above-mentioned harness cord respectively, and which can be coupled and uncoupled, while the device comprises an intermediate element which can be connected to the respective coupling elements for coupling of the coupling elements, and while the connection of at least one coupling element to the intermediate element is provided so that it can be broken as the result of a pulling force exerted thereon, in order to prevent damage through overloading.

When a certain pulling force (indicating overloading) is reached in the harness cord and the lifting cord, the coupling elements will uncouple, and the connection will be broken before the warp thread or one of the parts connected thereto breaks.

The device according to this invention is a mechanical protective element. When the coupling elements and the intermediate elements are being manufactured, the shape and the dimension are determined with such great accuracy that the coupling elements uncouple when a predetermined pulling force is reached. This force is sufficient in this case to ensure normal operation of the weaving machine, and is smaller than the force at which one of the abovementioned parts or a warp thread would break.

After the removal of the cause of the overloading pulling force, the coupling elements can be recoupled.

The coupling can also be carried out very easily and quickly, which—inter alia—saves a great amount of time during the connection of a large number of lifting cords and harness cords when a weaving machine is being made ready for operation.

Using an intermediate element give the advantage that one of the coupling elements or both coupling elements can be made of limited transverse dimension, so that they can be passed easily through openings or between parts of the weaving machine.

The transverse dimension of the first coupling element are preferably relatively small, because it is this element which generally has to be passed through narrow openings (e.g. a bore in a grate of the weaving machine and a slit in a tackle element) when the lifting cord is being fitted or replaced. (A tackle cord is subject to fairly great wear, owing to the fact that it is constantly rolling to and fro over a rolling element of a tackle element, with the result that it has to be replaced regularly).

The intermediate element and the second coupling element are in this case preferably provided so that they uncouple as the result of a certain pulling force exerted thereon, in order to prevent damage through overloading, while the intermediate element and the first coupling element are provided so that they remain coupled under the influence of the abovementioned pulling force.

Due to the limited transverse dimensions of the first coupling element, this embodiment is the most readily practicable one.

The device according to the invention is particularly user-friendly if the coupling elements can be coupled and uncoupled by hand. Besides, the coupling or uncoupling can be carried out very quickly in this way.

In a particularly advantageous way, the coupling elements are provided in such a way that in the coupled state they are rotatable relative to each other about an axis running virtually in the direction in which the lifting cord and the harness cord extend in the arrangement on a weaving machine.

The harness cord can consequently exert no rotation effect whatsoever on the lifting cord (e.g. tackle cord) or the parts connected thereto (e.g. jacquard selection hook). After their suspension on a weaving machine, the harness cord and the lifting cord will thus assume their free length, without twisting in the respective cords.

When the connections are being made between lifting cords and harness cords on a weaving machine, the lifting cords and the harness cords have to be passed through openings in a bottom board and/or grate.

According to a preferred embodiment of this invention designing the first and/or the second coupling element in such a way that it (they) can be pushed through an opening in a bottom board and/or grate, the connection between lifting cords and harness cords can be made easily and quickly without any removal of parts.

When a tackle element is provided for achieving the lift of a warp thread connected to the harness cord, it is also particularly advantageous if the first coupling element connected to the tackle cord can be pushed through the slit of the tackle element.

The connection between lifting cord and harness cord(s) can then be made without removal of the tackle element.

According to another preferred embodiment of the device according to this invention, the first and/or the second coupling element are provided with a transverse opening in the element.

This makes it possible to provide the various first coupling elements on a first carrying element, and/or the various second coupling elements on a second carrying element. The carrying elements extend, or are provided with parts which extend, through the above-mentioned transverse openings of the coupling elements provided thereon.

By providing the various coupling elements on a carrying element, it is ensured that they can be presented together—on their carrying element—for their connection to intermediate elements and/or to the other coupling elements provided on a carrying element or otherwise.

The method described above for achieving a connection between several lifting cords and harness cords on a weaving machine constitutes another object of this invention.

In the case of the known methods for achieving the several connections mentioned above, all connections are carried out manually one by one. This work is thus very time-consuming, particularly since a large number of connections generally have to be made on a weaving machine.

In the case of the method according to this invention, several connections can be achieved much more quickly through the better presentation of several coupling elements simultaneously.

Moreover, the coupling elements can be provided on their carrying element, in order to prevent the lifting cords and harness cords connected thereto from becoming entangled (for example, while the weaving machine is being transported), and in order to maintain their sequence. This again achieves a saving in time when several connections are being made between lifting cords and harness cords. Besides, this method is suitable for automation.

In a particularly preferred embodiment of the device according to this invention, the first and the second coupling element comprise a pin with a radially projecting head and a stud respectively, while the intermediate element comprises a body which encloses a first and a second channel, which open out by way of respective openings to the outside. The pin with head can extend through the opening in the first channel, while this channel comprises retaining means, in order to prevent axial displacement of the head towards the opening. The body of the intermediate element is provided with a recess, by way of which the pin with head can be placed in or removed again from the channel. The stud can be placed in the axial direction in the second channel, while the stud and the second channel are provided in such a way that the stud is retained in the second channel and can be pulled out of said second channel as the result of a certain pulling force exerted thereon in the axial direction.

According to a most preferred embodiment, the body of the intermediate element is elastically deformable, and the pin is provided with a radially projecting collar. The part of the pin between the collar and the head is the same shape and has the same dimensions as the part of the first channel between the opening and the retaining means, while the part of the recess by way of which the head can be placed in the first channel is situated past the retaining means, over a distance which is smaller than or equal to the length of the collar.

The features of the device according to this invention are clarified further by means of a detailed description of a non-limiting example of an embodiment thereof. In this description reference is made to the appended drawings:

BRIEF DESCRIPTION OF THE DRAWINGS

FIG. 1 is a perspective drawing of the coupling elements and the intermediate element in the uncoupled state.

FIG. 2 is a perspective drawing of the end of the first coupling element and the intermediate element in the uncoupled state.

FIG. 3 is a perspective drawing of the ends of both coupling elements and the intermediate element in the coupled state, in which the body of the intermediate element has been cut away over a quarter of the periphery.

FIG. 4 is a perspective drawing of both coupling elements and the intermediate element in the coupled state, in which the body of the intermediate element has been cut away over a quarter of the periphery.

FIG. 5 is a section in the lengthwise direction of the intermediate element.

DETAILED DESCRIPTION OF THE PREFERRED EMBODIMENTS

Figure 6:
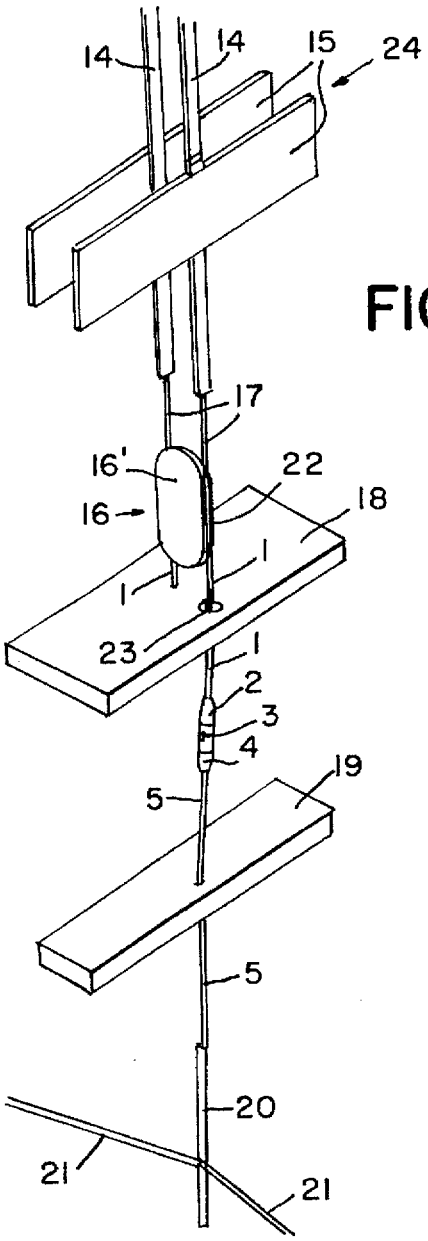
FIG. 6 is a perspective drawing of a device which is provided for lifting a warp thread on a weaving machine by way of a set of jacquard machine hooks, a tackle element and a device according to the invention.
Figure 7:
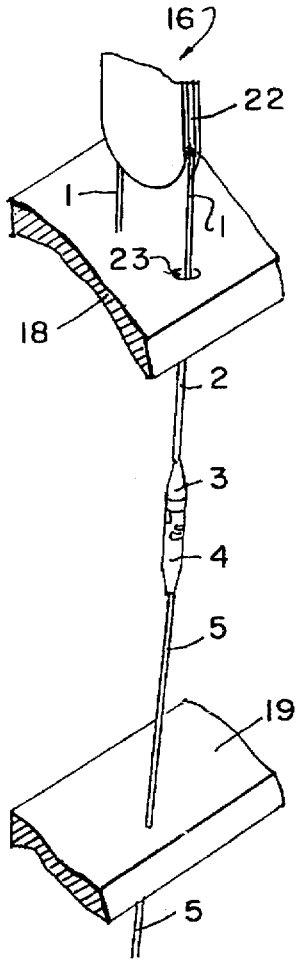
FIG. 7 is a detail drawing in perspective of a part of FIG. 6.

The first coupling element (2) is connected at one end to a bottom tackle cord (1), which is guided over the bottom roller element of a tackle element (16) of a jacquard machine (see FIGS. 6 and 7).

The bottom tackle cord (1) extends upwards through a bore (23) in a grate (18) and is connected by the other end to said grate (18), which is in a fixed position, or is movable vertically. A top tackle cord (17) is connected by each end to one of two complementary jacquard hooks (14). Each jacquard hook (14) is carried along by means of a knife (15), which moves up and down. Both knives (15) move in counterphase relative to each other.

By making the hooks (14) move along with the knives (15), or by selecting (retaining) one hook or both hooks (14) in a top (or bottom) position, a well-defined lift of a warp thread (21), extending through the heald eye of the jacquard heald (20), is produced by way of the top harness cord (17), the tackle element (16), the bottom tackle cord (1), the harness cord (5) and the jacquard heald (20). The harness cord (5) extends through a bore in a bottom board (19). The tackle element (16) comprises two flank plates (16'), between which the roller elements are rotatable disposed. A slit (22) is provided between the two roller elements—between the flank plates (16')—for passing through the tackle cords (17), (1).

The first coupling element (2) is cylindrical in shape (see FIGS. 1 to 4) and has a relatively small diameter (for example, 3.5 mm), so that this element (2) can be pushed through the bore of the bottom board (19) or grate (18), and through the slit (22) of the tackle element (16). This means that easy replacement of the tackle cord (1) is possible without removal of parts. The other end of the first coupling element (2) is provided with a cylindrical pin (2") extending along the axis of the body, which pin bears a radially projecting cylindrical head (2') on the free end.

The pin (2") has on the base, against the body of the coupling element (2), a radially projecting collar (2'''), the length of which is indicated by (a) in FIGS. 2 and 3.

The first coupling element (2) is provided with an elongated opening (6) which passes through the body.

The second coupling element (4) likewise has an elongated body which is cylindrical in shape, but which can have a larger diameter than that of the first coupling element (2), since it does not have to be pushed through bores or slits of small dimensions. Moreover, owing to this larger diameter, two or more harness cords (5) can be connected to the second coupling element (2).

The one or more harness cords (5) are connected at one end of the body, while the other end is provided with a cylindrical stud (4') projecting along the axis of the body.

The second coupling element (4) is also provided with an elongated opening (7) which passes through the body.

The intermediate element (3) comprises a body (3') with a cylindrical outer shape and encloses internal channels (10, 13) which open to the outside by way of two openings (8), (9), which are provided opposite each other in the ends of the body (3').

This internal space determines from the two openings (8), (9) a first channel (10) and a second channel (13), which are provided for the pin (2") with head (2') and for the stud (4') respectively (see FIG. 5).

The first channel (10) has a cylindrical part of virtually constant diameter running from the opening (8). The diameter and the length of this part correspond to the diameter and the length of the pin (2") of the first coupling element (2).

This part then passes into a cylindrical part of greater, constant diameter, so that an a annular edge (11) is formed in this first channel (10).

The diameter of this part of greater, constant diameter corresponds to the diameter of the head (2'). At the level of this first channel (10) a recess (12) is provided in the body (3') of the intermediate element (3), by means of which recess the pin (2") with head (2') can be pushed into or removed again from the first channel (10). Said recess (12) is provided from the end of the body (3') along the edge of the opening (8) of the first channel (10). From that end, up to a distance (b) past the annular edge (11) in the first channel (10), the recess is slit-shaped, having a width which is a little smaller than the diameter of the pin (2"). The recess (12) also forms a window (12') connecting to the slit-shaped part, and of a width and length corresponding at least to the diameter and the length of the head (2').

The distance (b) is smaller than or equal to the length (a) of the collar (2''').

The second channel (13) has a cylindrically shaped part of virtually constant diameter, running from the opening (9).

This part then passes via a slanting edge into a cylindrical part of greater, constant diameter. This latter part also passes into a cylindrical part of gradually decreasing diameter.

The body (3') of the intermediate element (3) is elastically deformable.

The pin (2") with head (2') can be pressed with the thumb and forefinger by way of the recess (12) into the first channel (10), the head (2') being placed in said channel (10) by way of the window (12'). The walls of the body (3') bend away from each other in the process, since the width of the slit-shaped part of the recess (12) is smaller than the diameter of the pin (2").

Due to the fact that the window (12') by way of which the head (2') is pushed into the first channel (10) is situated over a distance (b) past the annular edge (11), in a first phase of the coupling of the first coupling element (2) and the intermediate element (3) the collar (2'") is also pushed over a length (b) into the part of smaller diameter of the first channel (10) (by way of the slit-shaped part of the recess (12)). The length of the pin (2") between the collar (2'") and the head (2') in fact corresponds to the length of this part of smaller diameter of the first channel (10). After this first phase, the walls of the body (3') have not yet sprung back into their original position, since the collar (2'"), having a diameter which is greater than the diameter of the part of smaller diameter of the channel (10), is still situated in this part of the channel (10).

In a second phase, the first coupling element (2) is slid axially until the head (2') knocks against the annular edge (11). The collar (2'") in this case leaves the channel (10) by way of the opening (8), and the walls of the body (3') spring back to their original position.

The collar (2'"), on the one hand, and the head (2'), on the other, make any axial displacement of the first coupling element (2) relative to the intermediate element (3) impossible.

The coupling and uncoupling of the first coupling element (2) can easily be carried out by hand.

The stud (4') of the second coupling element (4) has a cylindrical part of constant diameter, running from the end of the body of said coupling element (4) and passing on—by way of a slanting edge—into a part of greater, constant diameter, which passes on into a conical part.

The shape of the stud (4') corresponds to the shape of the second channel (13), and the various diameters of the stud (4') and the channel (13) are such that the stud (4') can be placed in the axial direction in the channel (13) until the conical part, the part of greater, constant diameter and the part of smaller, constant diameter of the stud (4') are situated in the part of gradually decreasing diameter, the part of greater, constant diameter and the part of smaller, constant diameter respectively of the channel (13).

During the insertion of the stud (4'), the stud (4') and/or the body (3') of the intermediate element (3) is/are elastically deformed, so that the walls of the body (3') press against the stud (4').

Due to the fact that the stud (4') also knocks with its slanting edge against the slanting edge of the channel (13), the stud (4') cannot be pulled out of the channel (10) as the result of a normal pulling force (during normal working of the weaving machine).

The various dimensions and materials are determined in such a way that the resistance to pulling out of the stud (4') is overcome by a pulling force which occurs on overloading.

Due to the fact that the pin (2") with the head (2') is a cylindrical shape, and is placed in a cylindrical channel (10) of the intermediate element, the first coupling element (2) and the intermediate element (3) can rotate relative to each other in the coupled state, on that the harness cord cannot exert any rotation effect at all on the tackle cord (1) and on the jacquard selection hook (14). After suspension, the harness cord (5) will consequently assume its free length without twisting in the cord.

Figure 8A:
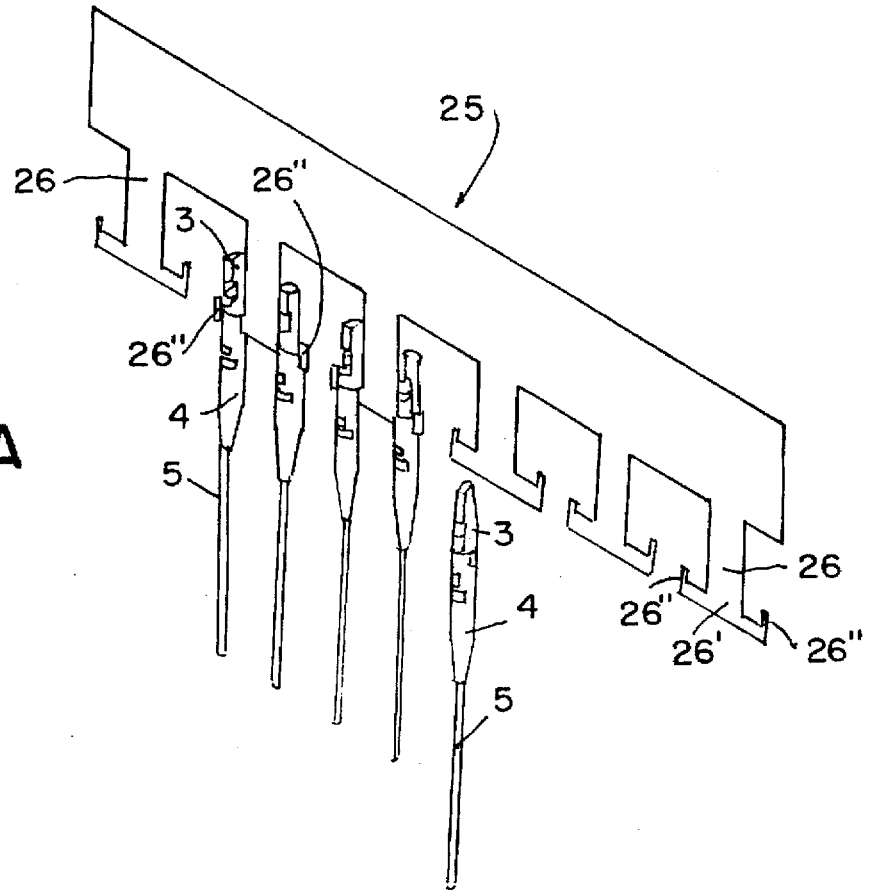
FIGS. 8A and 8B are perspective drawings of carrying elements in the form of combs for coupling the device according to the invention.
Figure 8B:
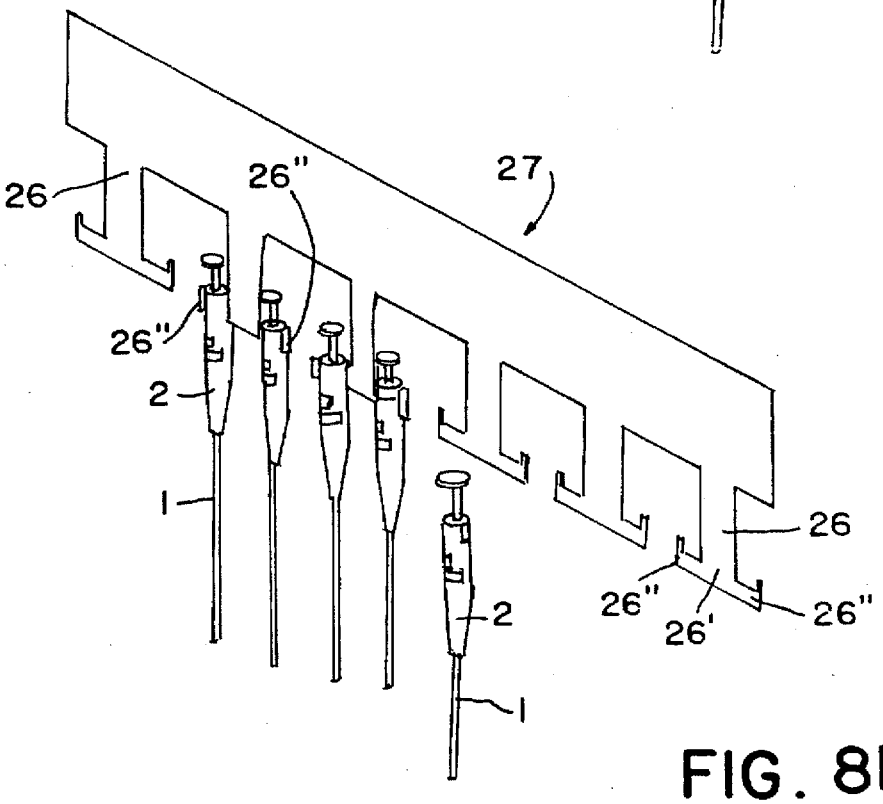

The time required to make the weaving machine ready for use is significantly reduced if the first coupling elements (2) and second coupling elements (4) are suspended from respective carrying elements (25), (27) so that they can be presented together for their connection to the intermediate elements (3) (see FIGS. 8A and 8B). A preferred carrying element (25), (27) is in the form of a flat strip which is the shape of a comb and has teeth (26) which end with a crosspiece (26') projecting at either side, so that the teeth (26) are essentially T-shaped. The crosspieces (26') are hook-shaped at both their ends (26"). For the suspension of the coupling elements (2), (4), the comb (25) is disposed with the teeth (26) facing downwards.

The coupling elements (2), (4) are then strung onto the crosspieces (26') of the teeth (26), so that said crosspieces (26') extend through the transverse openings (6), (7) in the coupling elements (2), (4), with the hook-shaped end (26") projecting upwards past the body of the coupling element (2), (4).

In addition to a faster and easier connection of the harness cords to the lifting cords, such a carrying element (and the method which provides for the use thereof) provides another advantage:

The coupling elements (2), (4) can in fact be suspended from their respective carrying elements (25) during the transportation of the weaving machine, in order to prevent the cords (1), (5) connected thereto from becoming entangled. Moreover, their correct sequence is maintained in this way, which again results in a saving of time when making the connections between lifting cords (1) and harness cords (5).

This method is also particularly suitable for automation, both for coupling the first coupling element (2) to the intermediate element (3), and for coupling the second coupling element (4) top the intermediate element (3).

The device according to the invention prevents breakage of the device (24) for lifting the warp threads and all elements (14, 15, 16, 17, 1, 5, 20) lying in between and transmitting the lift, and also permits very rapid and easy coupling. The coupling and uncoupling can be carried out repeatedly without any damage to the elements (2), (3), (4).

The elements (2), (3), (4) of the device according to the invention can be of any possible external shape, for example square or hexagonal.

The elements (2), (3), (4) are preferably made of plastic.

The coupling elements (2), (4) are preferably fixed on the lifting cords (1) and the harness cords (5) respectively by injection mold in a mold.

We claim:

1. Connection apparatus for weaving machines comprising plural lifting cords, plural harness cords, plural first and second coupling elements, wherein the first coupling elements are connectable to the lifting cords for lifting warp threads on weaving machines, and the second coupling elements are connectable to the harness cords for lifting the warp threads, said connection apparatus further comprising intermediate elements including means for removably connecting to the first and second coupling elements, wherein said means provide for the connections of the intermediate elements with at least one of the first and second coupling elements to be breakable when pulling forces are exerted thereon for preventing damage through overloading.

2. The apparatus of claim 1, wherein said connection means provide only for the second coupling elements and the intermediate elements therebetween to be breakable when pulling forces are exerted thereon.

3. The apparatus of claim 1, wherein the first and second coupling elements are adapted for effecting manual connections.

4. The apparatus of claim 1, wherein the first and second coupling elements when connected are adapted to be rotatable relative to each other about an axis of extension of the lifting and the harness cords on the weaving machines.

5. The apparatus of claim 1, wherein the first and/or the second coupling elements are adapted to be insertable through openings in grates and/or through openings in bottom boards of weaving machines.

6. The apparatus of claim 1, wherein the lifting cords are tackle cords with tackle elements having slits, and wherein the first coupling elements are connected to the tackle cords in slits of the tackle elements.

7. The apparatus of claim 1, wherein the first and/or the second coupling elements have transverse openings.

8. The apparatus of claim 1, wherein said connection means comprise pins provided on the first and the second coupling elements, each pin having a radially projecting head and a stud respectively, and the intermediate elements further comprising bodies having first and second channels, and first and second openings respectively, wherein the pins with respective heads are attachable through the openings in the first channels, the first channels including retainers for holding the heads and for preventing axial displacement of the heads towards the openings, the bodies including recesses for removably attaching the pins to the channels, and wherein the studs are attachable axially in the second channels and the studs are removable from the second channels by pulling forces exerted thereon in axial directions.

9. The apparatus of claim 8, wherein the bodies of the intermediate elements are elastically deformable, and further comprising radially projecting collars on the pins, wherein parts of the pins between the collars and the heads have shapes and dimensions similar to portions of the first channels between the openings and the retainers, and the recesses having portions for receiving the heads, the portions being provided at distances beyond the retainers, the distances being smaller than or equal to lengths of the collars.

10. A coupling method for connecting plural lifting and harness cords on weaving machines comprising providing first carriers and first couplers on the first carriers for carrying and presenting together the first couplers, connecting the first couplers to lifting cords, providing second carriers and second couplers on the second carriers for carrying and presenting together the second couplers, connecting the second couplers to the harness cords, providing intermediate couplers, and removably coupling the first and second couplers with the intermediate couplers.

* * * * *